US012103727B2

(12) United States Patent
Ruers et al.

(10) Patent No.: US 12,103,727 B2
(45) Date of Patent: Oct. 1, 2024

(54) HIGH SPEED TELESCOPIC FITTING OF A TRAY AND HOOD

(71) Applicant: The Procter & Gamble Company, Cincinnati, OH (US)

(72) Inventors: Henri Theo Leonie Ruers, Antwerp (BE); Andrea Ziantoni Liberatori, La Hulpe (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 18/107,697

(22) Filed: Feb. 9, 2023

(65) Prior Publication Data

US 2023/0257141 A1 Aug. 17, 2023

Related U.S. Application Data

(60) Provisional application No. 63/309,286, filed on Feb. 11, 2022.

(51) Int. Cl.
*B65B 7/28* (2006.01)
*B65B 57/08* (2006.01)

(52) U.S. Cl.
CPC ..... *B65B 7/2807* (2013.01); *B65B 7/2842* (2013.01); *B65B 57/08* (2013.01)

(58) Field of Classification Search
CPC ..... B65B 5/06; B65B 5/061; B65B 5/068; B65B 7/28; B65B 7/2807; B65B 7/2842; B65B 57/08
USPC ..... 53/471, 485, 282, 284.5, 306, 307, 313, 53/314, 315
See application file for complete search history.

(56) References Cited

U.S. PATENT DOCUMENTS 3,138,905 A * 6/1964 Ellinger ..... B65B 7/2871 53/485
3,383,834 A 5/1968 Switliski et al.
3,626,659 A * 12/1971 Breitbach ..... B65B 7/2807 53/313
3,694,999 A 10/1972 Switliski et al.
(Continued)

FOREIGN PATENT DOCUMENTS

CN 105691684 A 6/2016
DE 3143093 A1 * 5/1983 ..... B65B 7/28
(Continued)

OTHER PUBLICATIONS

U.S. Appl. No. 18/079,939, filed Dec. 13, 2022, to Paulus Antonius Augustinus Hoefte et. al.
(Continued)

*Primary Examiner* — Stephen F. Gerrity
(74) *Attorney, Agent, or Firm* — Andrew J. Mueller; Gary Joseph Foose; George H. Leal

(57) ABSTRACT

A process for packaging a product in which a hood is fitted to a tray. The hood top is oriented at an angle relative to the machine direction in which the tray is being conveyed. The hood is engaged with the tray by initiating contact between a leading panel of the hood with the tray while the leading panel is moving before engaging the trailing panel with the tray. As the tray is conveyed in the machine direction, the tray captures a hood by the leading panel of the hood and the remainder of the hood is subsequently fitted to the tray.

20 Claims, 9 Drawing Sheets

(56) References Cited

U.S. PATENT DOCUMENTS

| | | | | |
|---|---|---|---|---|
| 3,812,641 | A * | 5/1974 | Bemiss | B65B 7/2807 53/282 |
| 4,420,924 | A * | 12/1983 | Hoyrup et al. | B65B 7/2807 53/307 |
| 9,783,335 | B2 | 10/2017 | Everett | |
| 9,881,788 | B2 | 1/2018 | Kim et al. | |
| 10,017,291 | B2 | 7/2018 | Smith et al. | |
| 10,934,072 | B2 | 3/2021 | Lantz et al. | |
| 11,794,947 | B2 | 10/2023 | Hoefte et al. | |
| 11,851,232 | B2 | 12/2023 | Ruers et al. | |
| 2015/0068156 | A1* | 3/2015 | Zhou et al. | B65B 5/061 53/429 |
| 2015/0107197 | A1* | 4/2015 | Plessner et al. | B65B 7/2807 53/485 |
| 2018/0134467 | A1* | 5/2018 | Dagnelie et al. | B65B 7/2842 |
| 2018/0257827 | A1 | 9/2018 | Drosos et al. | |
| 2019/0062023 | A1 | 2/2019 | Lantz et al. | |
| 2021/0047072 | A1 | 2/2021 | Ng Pak Leung et al. | |
| 2022/0081155 | A1 | 3/2022 | Hoefte et al. | |
| 2022/0185534 | A1 | 6/2022 | Hoefte et al. | |
| 2022/0289436 | A1 | 9/2022 | Hoefte et al. | |
| 2022/0380086 | A1 | 12/2022 | Hoefte et al. | |
| 2023/0103439 | A1 | 4/2023 | Hoefte et al. | |
| 2023/0110630 | A1 | 4/2023 | Hoefte et al. | |
| 2023/0132541 | A1 | 5/2023 | Hoefte et al. | |
| 2023/0257145 | A1 | 8/2023 | Ruers et al. | |
| 2023/0264852 | A1 | 8/2023 | Hoefte et al. | |
| 2023/0264853 | A1 | 8/2023 | Hoefte et al. | |
| 2023/0286695 | A1 | 9/2023 | Hoefte et al. | |
| 2023/0322455 | A1 | 10/2023 | Beelen et al. | |
| 2023/0331447 | A1 | 10/2023 | Hoefte et al. | |
| 2024/0002100 | A1 | 1/2024 | Hoefte et al. | |

FOREIGN PATENT DOCUMENTS

| | | | | |
|---|---|---|---|---|
| EP | 0074673 | B1 | 5/1986 | |
| EP | 2251266 | A1 | 11/2010 | |
| EP | 3587293 | A1 | 1/2020 | |
| EP | 3741717 | A1 | 11/2020 | |
| EP | 3753856 | A1 | 12/2020 | |
| EP | 3907149 | A1 | 11/2021 | |
| FR | 2082695 | A5 * | 12/1971 | B65B 7/2807 |
| FR | 2487293 | A1 * | 1/1982 | B65B 7/2807 |
| FR | 2873097 | A1 * | 1/2006 | B65B 7/2807 |
| GB | 890434 | A | 2/1962 | |
| JP | 4536881 | B2 | 6/2010 | |
| WO | 2018022493 | A1 | 2/2018 | |

OTHER PUBLICATIONS

PCT Search Report and Written Opinion for PCT/US2023/061618 dated Jun. 22, 2023; 13 pages.

U.S. Appl. No. 18/506,351, filed Nov. 10, 2023, Henri Theo Leonie Ruers et al.

Extended EP Search Report and Search Opinion for 23155727.3 dated Aug. 10, 2023, 9 pages.

* cited by examiner

HIGH SPEED TELESCOPIC FITTING OF A TRAY AND HOOD

FIELD OF THE INVENTION

Process for assembling a tray and hood.

BACKGROUND OF THE INVENTION

High speed telescopic fitting of a tray and hood is an important process that can impact the productivity of a packing line. Commonly, paperboard or corrugate trays and hoods are telescopically engaged with one another to form a closed package after the trays are filled with goods. Processes in which one or both of the tray and the hood are indexed are common. In an indexed process for telescopically fitting together a tray and hood, one or both of the tray and hood undergo a movement that has a start and stop.

In one type of indexed process a filled tray is moved into a hooding station and is stationary while a hood is telescopically fitted to the tray. After the hood is fitted to the tray, the tray and hood are moved away from the hooding station. In another indexed process a hood is moved into a hooding station and is stationary while the tray is telescopically fitted to the hood. After the tray is fitted to the hood, the tray and hood are moved away from the hooding station.

Indexed processes tend to be slow. The start, stop, and movement control of the article being moved requires time. The time can be shortened by implementing greater accelerations from the start, greater decelerations before the stop, and greater velocities during the movement. An abrupt start or stop can generate appreciable forces by way of changes of momentum of the moving parts of the apparatus that performs the process and changes in the momentum of the articles being moved in process. As such, there are practical limits to how fast an indexed process can be conducted.

In a typical product packaging process, flat blanks are erected to form the tray and the hood. The flat blanks are constructed of paperboard or corrugate. The flat blank, which has various panels, flaps, tabs, slots, and the like, is deformed by folding the paperboard or corrugate to transform the flat blank into a three-dimensional structure. Adhesive, interlocking tabs and slots, and friction are used to position the panels and flaps to maintain the structural integrity of the tray and hood. When paperboard or corrugate is folded, stresses develop near and at the fold lines. These stresses may not entirely dissipate before construction and assembly of the tray and hood are completed. The residual stresses may result in warping of various panels and flaps of the tray and hood, particularly for large unsupported panels. Warping of the tray and hood may not be consistent with one another since the dimensions of the panels and flaps constituting the tray and hood may differ from one another. This inconsistency of warping may complicate fitting the hood to the tray using an indexed process, particularly if the tolerance for fitting the hood to the tray is small.

With these limitations in mind, there is a continuing unaddressed need for a high speed process for telescopically fitting a tray and a hood.

SUMMARY OF THE INVENTION

A process for packaging a product (1) comprising the steps of: manufacturing the product, wherein said product is a substrate treatment composition; providing a tray carriage system (120); providing a tray (10) movable in or on said tray carriage system; moving said tray at a tray velocity (TV) via said tray carriage system in a machine direction (MD); providing a dispensing system; dispensing said product into said tray via said dispensing system;

providing a hood engagement system above said tray carriage system and downstream of said dispensing system; providing a hood (60) moveable in said hood engagement system, wherein said hood comprises a leading panel (70), a trailing panel (80) opposite to and upstream of said leading panel, and a hood top (90) extending from said leading panel to said trailing panel, wherein said hood top is oriented at an angle (β) from about 0.5 degrees to about 20 degrees relative to said machine direction; engaging said hood with said tray via said hood engagement system to close said tray to form a closed package (110), wherein said hood is engaged with said tray while said tray is moving in said machine direction by initiating contact between said leading panel and said tray while said leading panel is moving before engaging said trailing panel with said tray; and shipping said closed package.

DETAILED DESCRIPTION OF THE INVENTION

A high speed process for telescopically fitting a hood to a tray is described herein. The process can be a part of an end to end process for packaging a product. The product can be any product of the type that can be shipped in a paperboard or corrugate package comprising a tray and a hood telescopically fitted to one another. The product can be a substrate treatment composition. The product can be a substrate treatment composition selected from a laundry treatment composition, a hard surface treatment composition, a laundry washing machine treatment composition, a hair treatment composition, a skin treatment composition, an oral care composition, a cosmetic composition, a nail treatment composition, an air treatment composition, a dish treatment composition, a disposable absorbent article, and a topical or ingested health care composition. The substrate treatment composition can comprise an ingredient selected from a surfactant, a bleach, a fabric softener, and combinations thereof.

Figure 1:
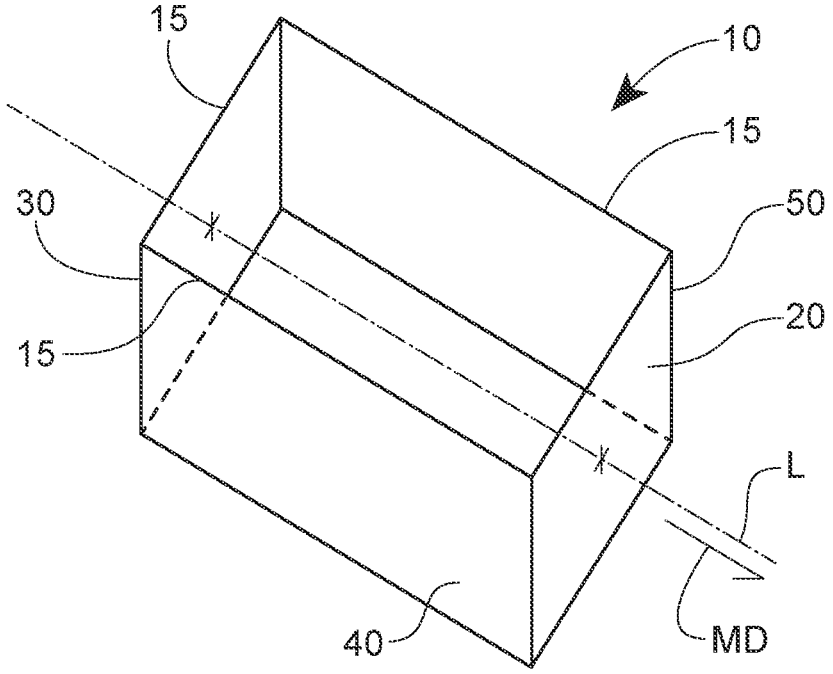
FIG. 1 is a tray.

A tray 10 employed in the process is shown in FIG. 1. The tray 10 and hood can be formed of paperboard or corrugate. Paperboard and corrugate materials can comprise pulp. The paperboard or corrugate can have a thickness from 1 mm to about 3 mm. The paperboard or corrugate can be a laminate. The paperboard or corrugate can comprise pulp. The paperboard or corrugate can comprise colorants, preservatives, plasticizers, ultraviolet stabilizers, oxygen, perfume, recycled materials, moisture barriers, and combinations thereof. Corrugate can comprise a laminate of two sheets of paperboard having a fluted layer disposed between the two sheets of paperboard. Each of the tray 10 and hood can be a single piece of die cut paperboard or corrugate having a pattern of the faces of the tray 10 or hood and flaps extending from the faces or panels. The tray 10 or hood can be erected by joining a combination of the flaps or a combination of the flaps and faces or panels to erect the tray 10 or hood. The flaps and or faces or panels can be joined to one another by gluing, thermal bonding, fitting tabs to slots, and engaging interlocking structures.

The tray 10 can be conveyed in a machine direction MD. The tray 10 can comprise a leading face 20 and a trailing face 30 upstream of the leading face. The tray 10 can have a front face 40 and a back face 50 opposite the front face 40. The front face 40 and the back face 50 extend from the leading face 20 to the trailing face 30 in the machine direction MD. The tray 10 can comprise a peripheral rim 15 defining a top opening of the tray 10. The tray 10 can have a longitudinal axis L in line with the machine direction MD.

Figure 2:
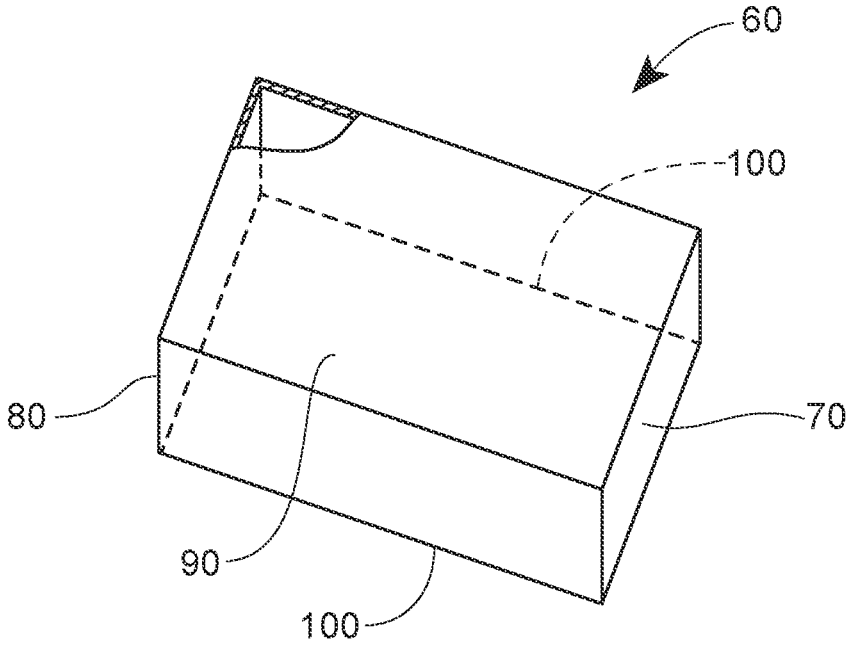
FIG. 2 is a hood.
Figure 3:
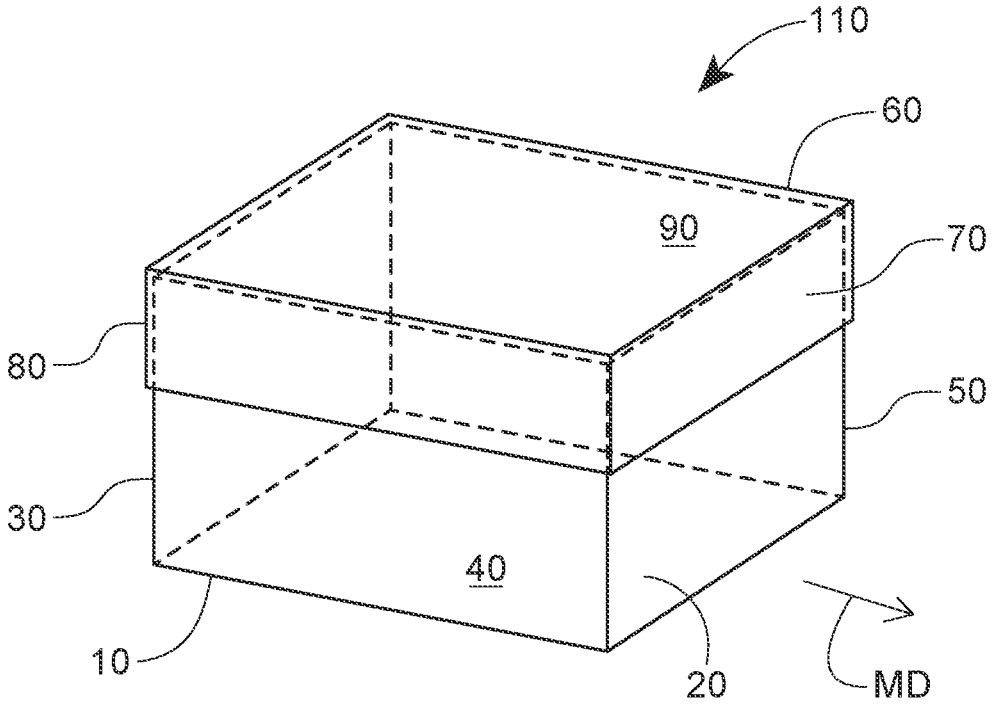
FIG. 3 is a tray having a hood fitted thereto.

A hood 60 employed in the process is shown in FIG. 2. The hood 60 can be formed of paperboard or corrugate. The hood 60 can comprise a leading panel 70, trailing panel 80 opposite to and upstream of the leading panel 70, and a hood top 90 extending from the leading panel 70 to the trailing panel 80. The hood 60 can comprise a pair of opposing hood side peripheral edges 100. The hood 60 can be telescopically fitted to the tray 10 to form a closed package 110 (FIG. 3). If the hood 60 is fabricated of corrugate, the flutes can be aligned or substantially aligned with the fold lines between the hood top 90 and the leading panel 70 and the hood top 90 and the trailing panel 70. Such an arrangement can provide for a sharp fold line between the hood top 90 and the leading panel 70 and the trailing panel 70.

The hood 60 can be telescopically fitted to the tray 10 following an assembly process illustrated in FIGS. 4A to 4D. The hood 60 can be movable in a hood engagement system that is above the tray carriage system that carries the tray 10. It is to be understood that the tray 10 is moving in a machine direction MD. The hood 60 is also moving such that the component of velocity of the hood 60 in the machine direction MD is greater than the component of velocity of the hood 60 in a direction orthogonal to the machine direction MD. The component of velocity of the hood 60 in the machine direction MD may be five times, seven times, ten times, fifteen times, or twenty times greater than the component of velocity of the hood 60 in a direction orthogonal to the machine direction MD. The hood 60 can approach the tray 10 at an approach angle β of from about 0.5 degrees to about 20 degrees, optionally from about 0.5 degrees to about degrees, optionally from about 1 to about 5 degrees, optionally about 4 degrees, above the machine direction MD, the approach angle vertex being oriented downstream in the machine direction MD.

Figure 4A:
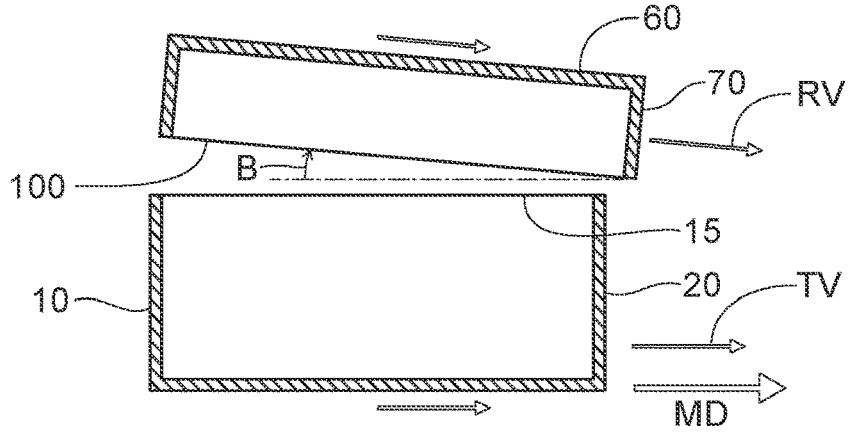
FIGS. 4A to D illustrate a hood being progressively fit to a tray.
Figure 4B:
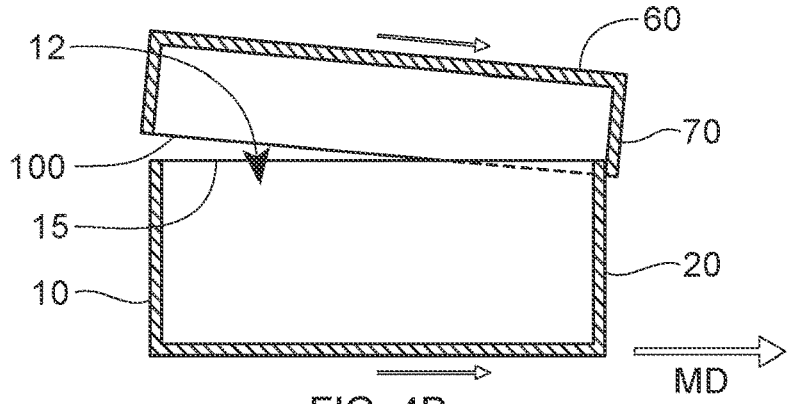
Figure 4C:
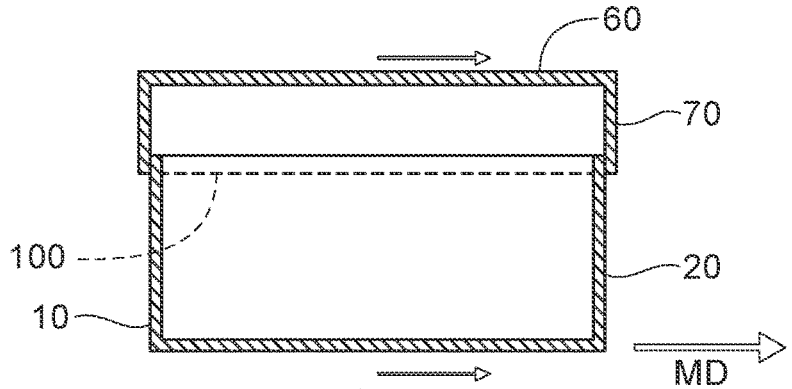
Figure 4D:
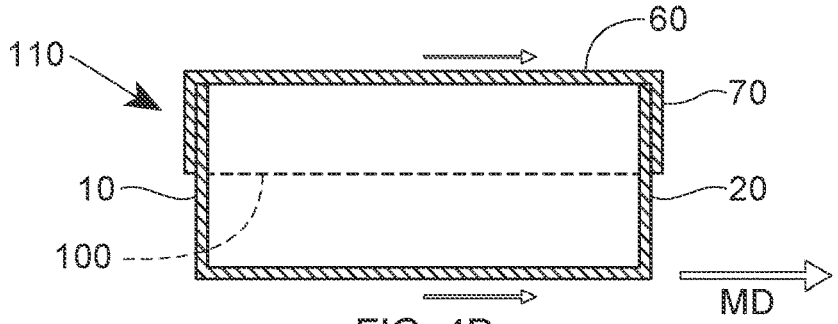

The hood 60 leads the tray 10 in the machine direction MD immediately before the hood 60 first contacts the tray 10, as shown in FIG. 4B. The hood 60 is engaged with the tray 10 while the tray 10 is moving in the machine direction MD by contacting the leading panel 70 of the hood 60 and the tray 10 while the leading panel 70 is moving before engaging the trailing panel 80 of the hood 60 with the tray 10. In operation, hood 60 is fed towards the tray 10 in a manner such that the leading panel 70 of the hood is in a leading position over the tray 10 in the machine direction and the leading face 20 of the tray 10 catches up to and contacts the leading panel 70 of hood 60. Once the leading face 20 of the tray 10 contacts the leading panel 70 of the hood 60, the trailing panel 80 of the hood 60 tips towards the trailing face 30 of the tray 10 which positions the trailing panel 80 of the hood 60 in position to be fitted over the trailing face 30 of the tray 10, as shown in FIG. 4C. With both the leading panel 70 and the trailing panel 80 of the hood 60 positioned over leading face 20 and trailing face 30 of the tray 10, respectively, the hood 60 is in position to be completely engaged with the tray 10 to close the package, as shown in FIG. 4D. A mechanism can be provided downstream of the location at which the hood 60 and tray 10 merge to completely engage the hood 60 and tray 10.

The hood 60 can have a pair of opposing hood side peripheral edges 100 that extend between the leading panel 70 and the trailing panel 80 of the hood 60. The tray 10 can have a peripheral rim 15 that defines a top opening 12 of the tray 10. When the leading panel 70 of the hood 60 first contacts the leading face 20 of the tray 10, about 5% to about 50%, optionally about 10% to about 40%, optionally about 15% to about 30%, optionally about 10% to about 25%, of each hood side peripheral edge is below the peripheral rim 15 of the tray 10. By positioning the hood 60 and the tray 10 as such, the hood 60 is tipped slightly relative to the tray 10 and as the tray 10 catches up to the hood 60 enough of the hood 60 is engaged with the tray 10 for the tray to catch the hood 60 and the hood 60 can slip into place over the tray 10 or the hood 60 can be further manipulated to more completely engage the hood 60 with the tray 10.

The hood engagement system moves the hood 60 at a reference velocity RV. The reference velocity RV may be constant or variable and is non-zero. Likewise the tray carriage system moves the tray 10 at a tray velocity TV in the machine direction MD. The tray velocity TV may be constant or variable and is non-zero. One or both of the hood engagement system and tray carriage system may have controls so that the reference velocity RV of the hood and or the tray velocity TV of the tray, respectively, may be controlled. The control systems can employ vision systems that include a camera, an image acquisition system, and image analysis software, connected through a programmable logic controller. The vision system can be capable of measuring parts, verifying the position of parts, and recognizing the shape of parts. Based on inputs from the vision system, the control system can influence the process by altering the reference velocity RV of the hood and the tray velocity TV. Optionally, one or more photo eyes may be provided to detect the presence or lack of presence of parts of the hood and tray as well as the positions of elements of the assembly equipment and the control system can receive such input and operate the hood engagement system on the basis of such input.

Optionally, the tray velocity TV may be altered in response to a detected position of the hood 60 so that when the leading panel 70 first contacts the tray 10 about 5% to about 50%, optionally about 10% to about 40%, optionally about 15% to about 30%, optionally about 10% to about 25%, of each hood side peripheral edge 100 is below the peripheral rim 15. Further optionally, the reference velocity (RV) of the hood 60 may be altered in response to a detected position of the tray 10 so that when the leading panel 70 first contacts the tray 10 about 5% to about 50%, optionally about 10% to about 40%, optionally about 15% to about 30%, optionally about 10% to about 25%, of each hood side peripheral edge 100 is below the peripheral rim 15.

Altering one or both of the reference velocity RV and tray velocity TV can help to ensure that the leading panel 70 of the hood is in an acceptable, or even optimal, position relative to the leading face 30 of the tray 10 to provide for engagement of the hood 60 and the tray 10 in the manner described. This is different from processes in which trays 10 are conveyed at a uniform pitch distance on a conveyor and a hood engagement system feeds hoods 60 at regular intervals to meet up with the trays 10. Such systems may suffer from the defect that small variations in the pitch distance of the trays may result in the hood 60 being improperly fitted to the tray or possibly not even being fitted thereto at all. Moreover, the hood engagement system must be precisely synchronized with the tray carriage system to provide for proper fitting of the hood 60 to the tray 10. Being able to control and alter one or both of the reference velocity RV and tray velocity TV can overcome these deficiencies.

Figure 5:
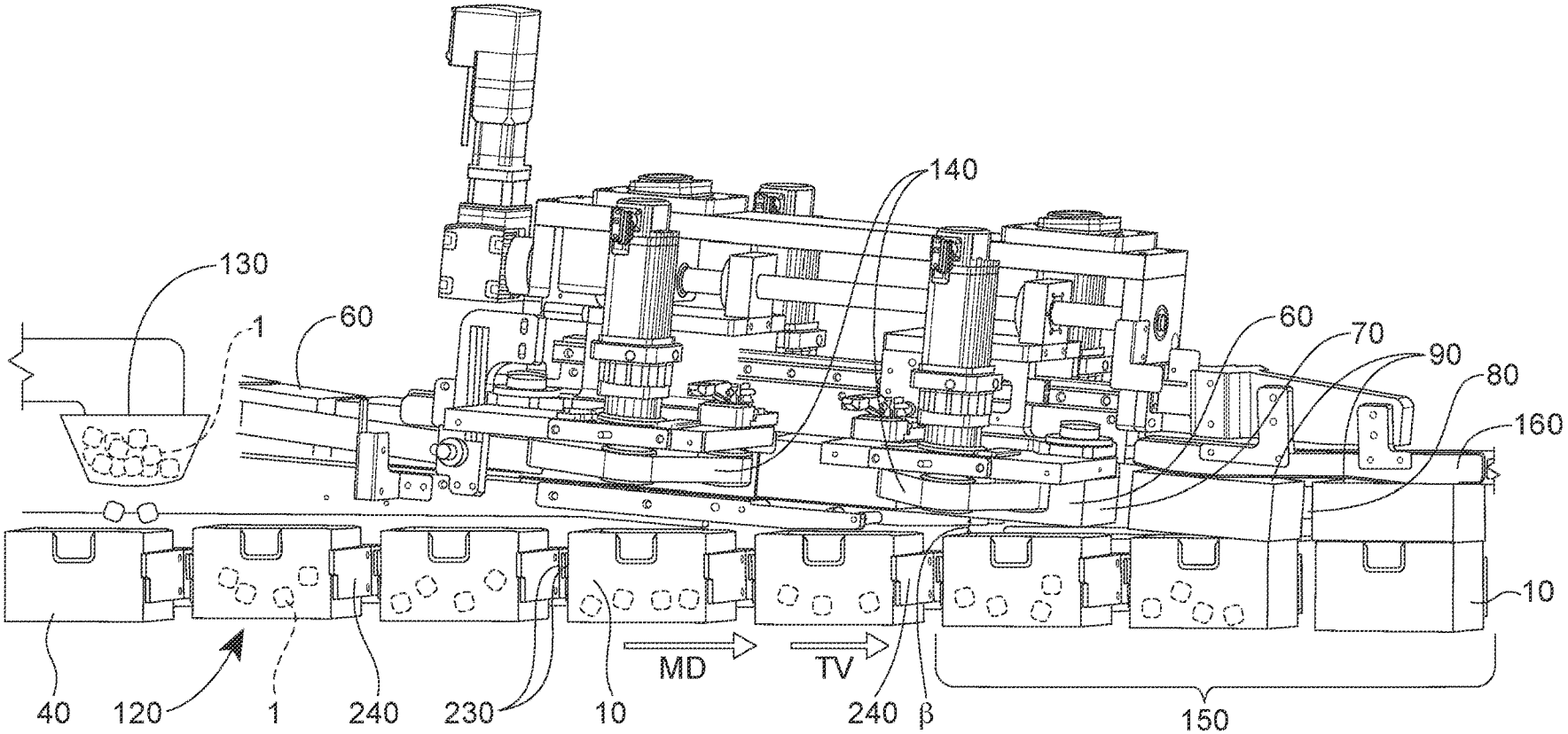
FIG. 5 is a packaging line for dispensing products into a tray and fitting a hood to the tray to close the package.

The high speed process for telescopically fitting a hood to a tray described herein can be part of an end to end process for packaging a product 1, as shown in FIG. 5. The steps of the process can include manufacturing the product 1. The product 1 can be a substrate treatment composition. A tray carriage system 120 can be provided. The tray 10 can be provided and be movable in or on the tray carriage system 120. The tray 10 can be moved at the tray velocity TV via the tray carriage system 120 in the machine direction MD. The tray velocity TV can be constant or variable.

A dispensing system 130 can be provided and the product 1 can be dispensed into the tray via the dispensing system 130. A hood engagement system 140 can be provided above the tray carriage system 120 and downstream of the dispensing system 130. The hood 60, which has a leading panel 70 and a trailing panel 80 opposite to and upstream of the leading panel 70 can be oriented at the angle β, which is from about 0.5 degrees to about 20 degrees, optionally from about 2 degrees to about 15 degrees, optionally from about 5 degrees to about 10 degrees, relative to the machine direction.

The dispensing system 130 can comprise a product hopper that is positioned above the tray carriage system 120. The hopper holds a quantity of products 1 that are to be dispensed into the tray 10. For example, if the package 110 is supposed to contain ten products 1, then the hopper holds ten products 1 to be dispensed into the tray 10. A system can be provided upstream of the hopper or be integrated with the hopper that counts the number or weight of products dispensed into the hopper. The weighing system can be a multi-head rotary weigher. A suitable weighing system can be a CCW-RV weighing system available from ISHIDA, Kyoto, Japan (https://www.ishida.com/ww/en/). Opening and closing of the hopper can be controlled by a controller that receives information on the position of the tray 10 and appropriate weight, count, or volume of product contained in the hopper. The controller can generate an activation signal to open the hopper when all logic conditions are met. The controller can then direct that the hopper be refilled with an appropriate weight, count, or volume of product to be dispensed the next time the hopper is opened.

The hood 60 is engaged with the tray 10 via the hood engagement system 140 to close the tray 10 to form the closed package 110. The hood 60 is engaged with the tray 10 while the tray is moving in the machine direction MD by initiating contact between the leading panel 70 and the tray 10 while the leading panel 70 is moving before engaging the trailing panel 80 with the tray 10. Importantly, both the tray 10 and the hood 60 are moving when contact between the leading panel 70 and the tray 10 is initiated, which differentiates this approach for fitting a hood 60 to a tray 10 from those in which the tray 10 is stationary while the hood 60 is fitted to the tray and those in which the hood 60 is stationary while the tray 10 is fitted with the hood 60. Likewise, this approach differs from an approach in which a hood 60 is held at a stationary position and tipped at an angle open towards the upstream direction and the tray 10 is driven to contact the hood 60, thereby fitting the hood 60 to the tray 10. In the process described herein, the hood 60 is moving at a reference velocity RV and the tray is moving at a tray velocity TV at the instance the hood 60 and tray 10 first contact one another.

The leading panel 70 can be first engaged with the tray 10 at a merging location 150 along the tray carriage system 120. The hood engagement system 140 can further comprise a hood guide 160 above the tray carriage system 120 at or downstream of the merging location 150. The hood guide 160 can be nearer to the tray carriage system 120 downstream of the merging location 150 than at the merging location 150. The hood guide 160 can contact the hood top 90 to telescopically fit the hood 60 onto the tray 10. The hood guide 160 can be a wedge that pushes the hood 60 to fit to the tray 10. The hood guide 160 can be a belt that is positioned at a small angle relative to the machine direction MD to force the hood 60 to fit to the tray.

After the hood 60 is fitted to the tray 10, the closed package 110 can be shipped. For example, the closed package 110 can be shipped to a distributor or distribution facility and further along the supply chain until it reaches a location at which a user can open the package 110 by removing the hood 60, retrieve the product 1 from the tray 10, and use the product 1.

Figure 6:
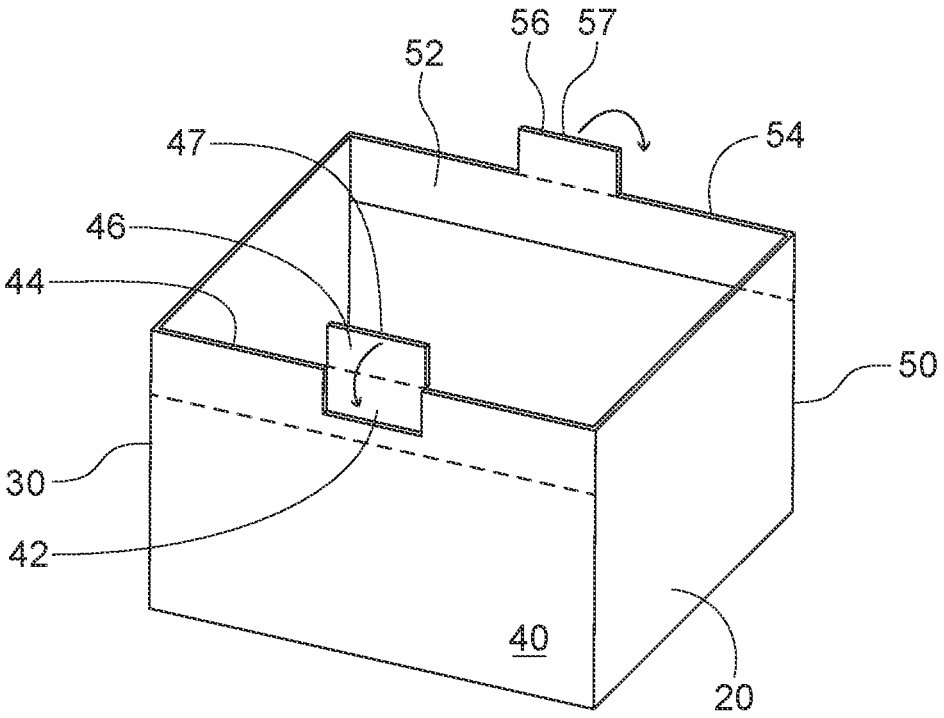
FIG. 6 is a tray having flaps.

The tray 10 can have a front face fold back 42 that is an integral extension of the front face 40 folded towards the interior of the tray 10 along a front face fold line 44 (FIG. 6). Similarly, the tray 10 can have a back face fold back 52 that is an integral extension of the back face 50 folded towards the interior of the tray 10 along a back face fold line 54. The front face fold back 42 and back face fold back 52 can provide for additional rigidity to the peripheral rim of the tray 10.

A front face flap 46 can extend from the peripheral rim 15 along the front face 40. The front face flap 46 can extend from the front face 40 to a front face flap distal end 47. A back face flap 56 can extend from the peripheral rim 15 along the back face 50. The back face flap 56 can extend from the back face 50 to a back face flap distal end 57. The front face flap 46 and back face flap 56 can be structured from cutlines in the front face 40 and back face 50, respectively. The front face fold back 42 and back face fold back 52 can extend more deeply into the tray 10 than the cut lines that form the boundary of the front face flap 46 and back face flap 56.

The front face fold line 44 and back face fold line 56 can be orthogonal to the flutes if the tray is constructed from corrugate. For corrugate, folding perpendicular to the flutes can provide for a hinge having springiness about the fold. For the tray 10 described herein, the springiness can be employed to form a closure system that engages the hood 60 with the tray 10 that can be opened and closed multiple times.

The blank from which the tray 10 is erected can include cut lines that define the shape and dimensions of the front face flap 46 and back face flap 56 and the cut lines can be positioned so that when the tray 10 is erected the front face flap 46 and the back face flap 56 are positioned as desired. As part of the process of erecting the tray 10 from the blank, the front face fold back 42 and back face fold back 52 can be folded towards the interior of the tray 10. The parts of the front face fold back 42 and the back face fold back 52 from which the front face flap 46 and the back face flap 56 extend, respectively, can be unfolded and pointing upward after the tray 10 is erected. When the tray 10 is erected and the front face fold back 42 and the back face fold back 52 are folded towards the interior of the tray 10, the front face flap 46 and the back face flap 56 can protrude upwardly from the peripheral rim 15 of the tray 10.

As part of the process of packaging the product 1, the front face flap 46 and the back face flap 56 can be folded outwardly away from the interior of the tray 10 before engaging the hood 60 with the tray 10. The front face flap 46 and the back face flap 56 can be held down while engaging the hood 60 with the tray 10. The front face flap 46 and the back face flap 56 can be outwardly folded by a pair of folding rails that are associated with the tray carriage system 120. As the tray 10 is transported downstream, the folding rails can capture the distal ends of the flaps and movement of the tray 10 downstream and shaping of the folding rails can bend the front face flap 46 and the back face flap 56 outwardly away from the interior of the tray 10 so that the distal ends of the respective flaps are oriented towards the bottom of the tray 10.

Figure 7:
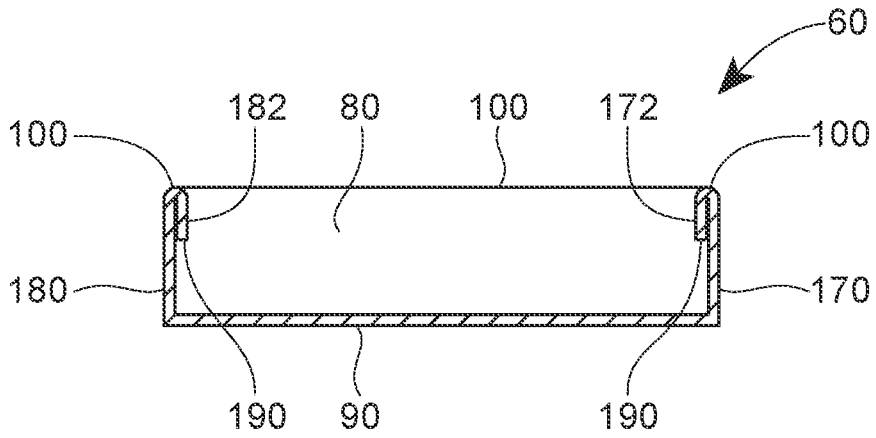
FIG. 7 is a cross section of a hood having inwardly folded flaps along the front panel and back panel.

The hood 60 can be provided with an engagement mechanism that cooperates with the front face flap 46 and back face flap 56, by way of nonlimiting example as shown in FIG. 7. FIG. 7 is a cross section of a hood 60 looking in the upstream direction toward the hood trailing panel 80. The hood 60 can further comprise a front panel inwardly folded flap 172 extending from the front panel 170 and a back panel inwardly folded flap 182 extending from the back panel 180. Together the front panel 170 and back panel 180 can extend from the leading panel 70 to the trailing panel 80. And the front panel inwardly folded flap 172 and the back panel inwardly folded flap 182 can be between the front panel 170 and the back panel 180.

Figure 8:
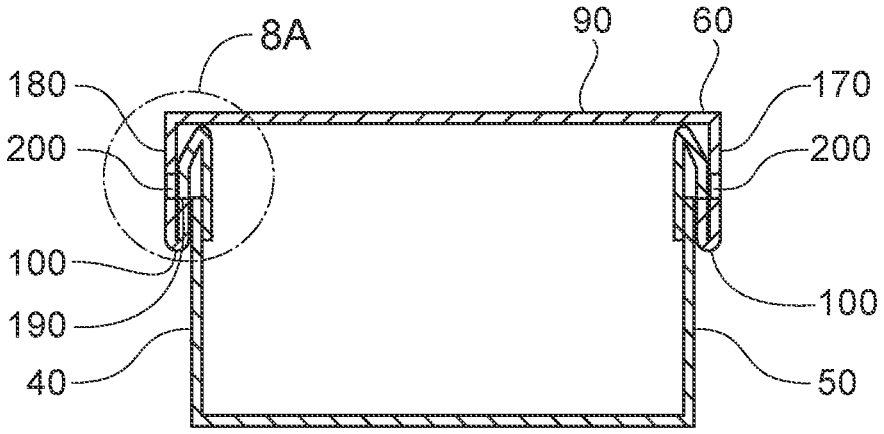
FIG. 8 is a cross section illustrating the fit of a flap to an inwardly folded flap to secure the hood to the tray.
Figure 8A:
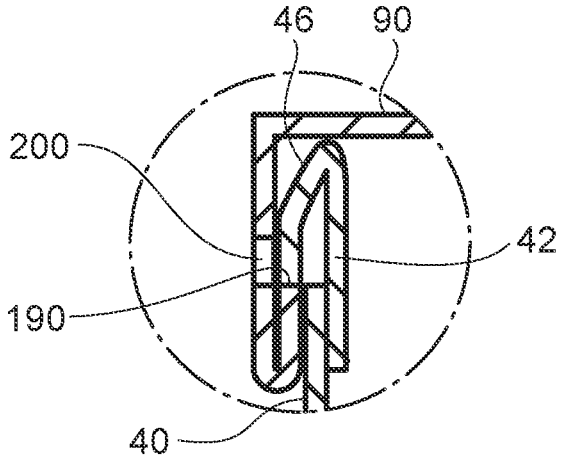
FIG. 8A is a partial view, as marked in FIG. 8, illustrating the fit of a flap to an inwardly folded flap to secure the hood to the tray.

When the hood 60 is fitted to the tray 10, the distal ends of the front face flap 46 and back face flap 56 can engage with the ends 190 of the front panel inwardly folded flap 172 and the back panel inwardly folded flap 182, respectively (FIG. 8). When the hood 60 is properly fitted to the tray 10, an audible click can be generated by the front face flap 46 and back face flap 56 engaging with the ends 190 of the front panel inwardly folded flap 172 and the back panel inwardly folded flap 182, respectively. The audible click can be monitored during the assembly process and used as a quality assurance measure to detect that the locking mechanism is properly engaged. Moreover, when the package 110 is used in a consumer's household, the audible click generated when the hood 60 is properly fitted to the tray 10 can be a signal to the consumer that the package 110 is properly closed.

Optionally the hood 60 can be provided with a hood insert that projects from the interior facing surface of the hood top 90. The hood insert can be sized and dimensioned to fit within the top portion of the interior space of the tray 10 near the peripheral rim 15 of the tray 10. The hood insert can be a piece of paperboard or corrugate, optionally a folded piece of paperboard or corrugate, joined to the interior facing surface of the hood top 90. The hood insert can a structure like that disclosed in U.S. Patent Application 63/299,582 that is a flat insert that upon erecting the hood 60 part of the flat insert becomes spaced apart from the interior of the hood top. That spaced apart portion, which projects towards the interior space of the tray when assembled, can help guide the hood 60 to being fitted properly with the tray 10.

Figure 9:
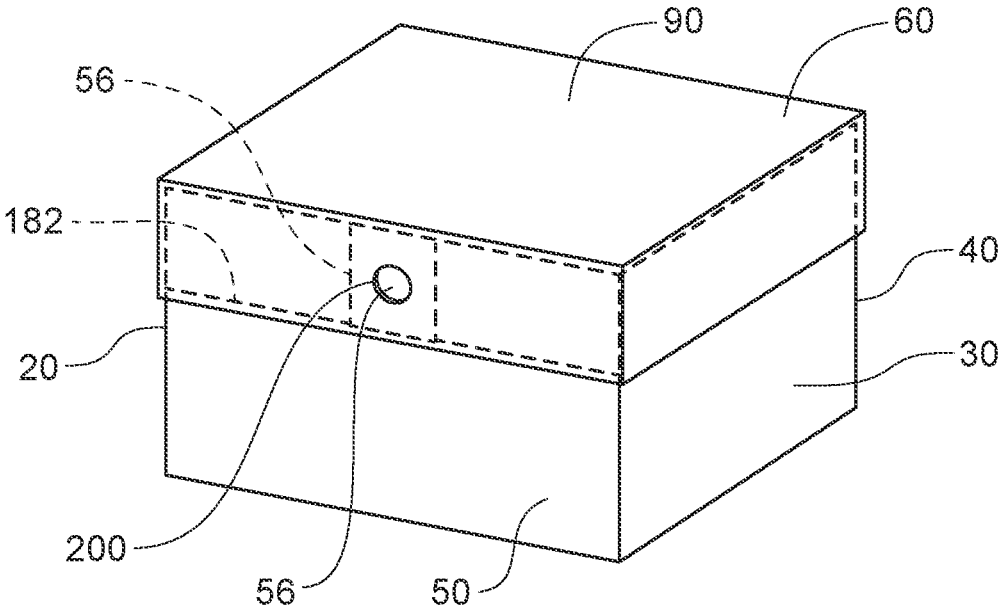
FIG. 9 is a package in which the hood is provided with an aperture so that the user can access the inwardly folded flaps to open the package.

The user can unlock the hood 60 from the tray 10 by pushing on the front face flap 46 and the back face flap 56 to release the distal ends of front face flap 46 and the back face flap 56 from contact with the ends 190 of the front panel inwardly folded flap 172 and the back panel inwardly folded flap 182, respectively. The front face flap 46 and the back face flap 56 rotate about a hinge formed by the front face fold line 44 and the back face fold line 54. The front face flap 46 can be accessed through an aperture 200 in the front panel 170. The back face flap 56 can be accessed through an aperture 200 in the back panel 180 (FIG. 9). Engagement of the face flaps and the ends of the panel inwardly folded flaps can be checked by a vision system or other sensor sighted on and or around the apertures 200. The presence of the face flaps can be detected by measuring the color behind the aperture 200, for example. If the face flaps are in the proper position a first color may be detected. If the face flaps are not in the proper position the color of the back sides of the front panel and back panel may be detected as a second color and a system fault generated to reject the package when the second color is detected or the first color is not detected.

Figure 10:
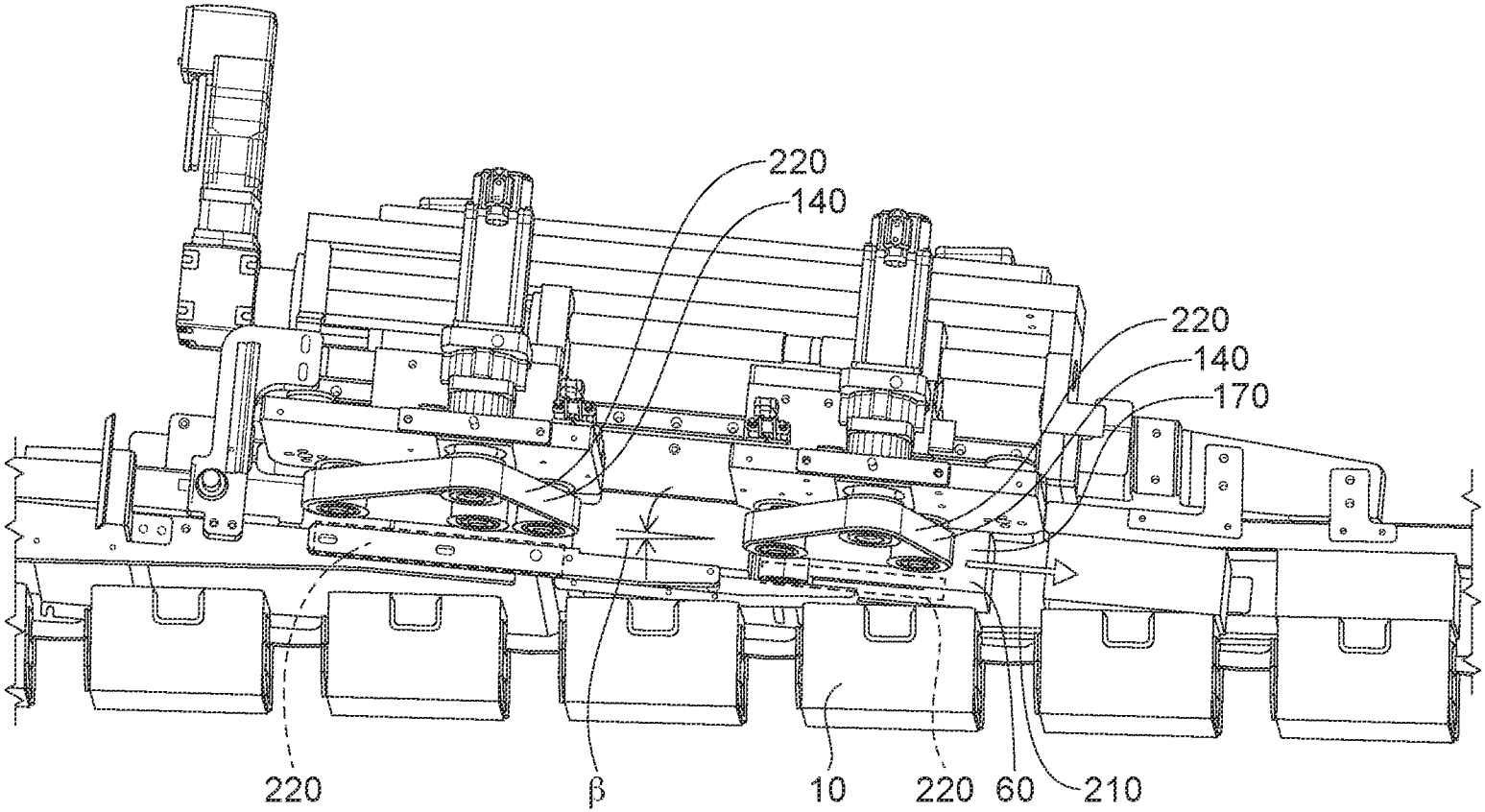
FIG. 10 is a hood engagement system for feeding hoods to be captured by a tray.

The hood engagement system 140 is the mechanism for positioning a hood 60 so that the hood 60 can be captured by a tray 10 as the tray 10 moves downstream in the machine direction MD. As shown in FIG. 10, the hood engagement system 140 can comprise a hood travel pathway 210 oriented towards and at an angle $\beta$ to the carriage system 120. The hood travel pathway 210 can be disposed between two hood drivers 220. The hood drivers 220 can move the hood 60 by contacting the hood 60. A hood driver 220 can be a belt. A hood driver can be a roller. Counter rotating hood drivers 220 can move the hood 60 by contacting the front panel 170 and back panel 180 to push or draw the hood 60 in the downstream direction. The tangential velocity of the hood drivers 220 can be individually controlled and controllable so that movement of the hood 60 can be synchronized with movement of the tray 10 so that the tray 10 captures a hood 60 as the tray 10 moves in the downstream direction. For each hood driver 220 visible to the viewer of FIG. 10, there is optionally an opposing hood driver 220 hidden from view on the opposite side. That is, when looking downstream, hood drivers 220 may be present on both the left and right sides of the machine direction MD.

The hood 60 may tightly conform to the tray 10 to provide for a robust connection between the hood 60 and tray 10 for the closed package 110. If the conformance between the hood 60 and the tray 10 is tight, processes that operate at a fixed rate with little or no control over movement of one or both of the hood 60 and tray 10 may be inadequate to enable the tray 10 to catch a hood 60 as the hood 60 merges with the tray 10.

Figure 11:
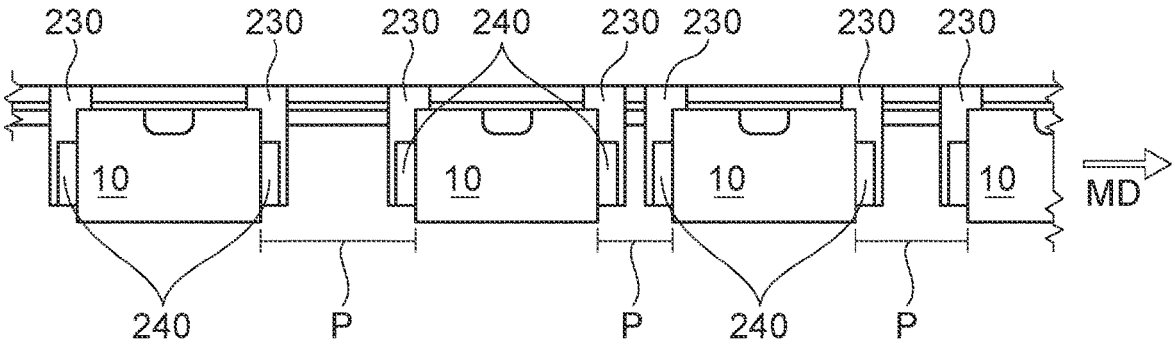
FIG. 11 is a tray carriage system.

Precise control of movement of the tray 10 can be provided by a carriage system 120 comprising a plurality of linear motor vehicles 230 (FIG. 11). The carriage system 120 can be a horizontally oriented track system in which movement of individual linear motor vehicles 230 is controlled. A suitable linear motor track system can be an ITRAK system from Rockwell Automation. A tray 10 can be conveyed by adjacent linear motor vehicles 230. Each linear motor vehicle 230 can have a restraint plate 240 attached thereto. The restraint plate 240 can be oriented orthogonal to the machine direction MD. Each tray 10 can be held by restraint plates 240 of adjacent linear motor vehicles 230. In operation, adjacent pairs of linear motor vehicles 230 can be individually controlled or controlled in pairs to hold a tray 10 between the restraint plates 240 of adjacent linear motor vehicles 230.

The pitch P amongst trays 10 can be nonconstant and individually controlled. The position of individual trays 10 can be controlled to match up with the position of the hood 60 being fitted thereto. Vision systems or sensors can detect the position and speed of the hood 60 and a computer system can adjust the velocity of the tray 10 so that the hood 60 is captured by a tray 10 as the tray 10 passes through the location at which the hood 60 merges with the tray 10.

Figure 14:
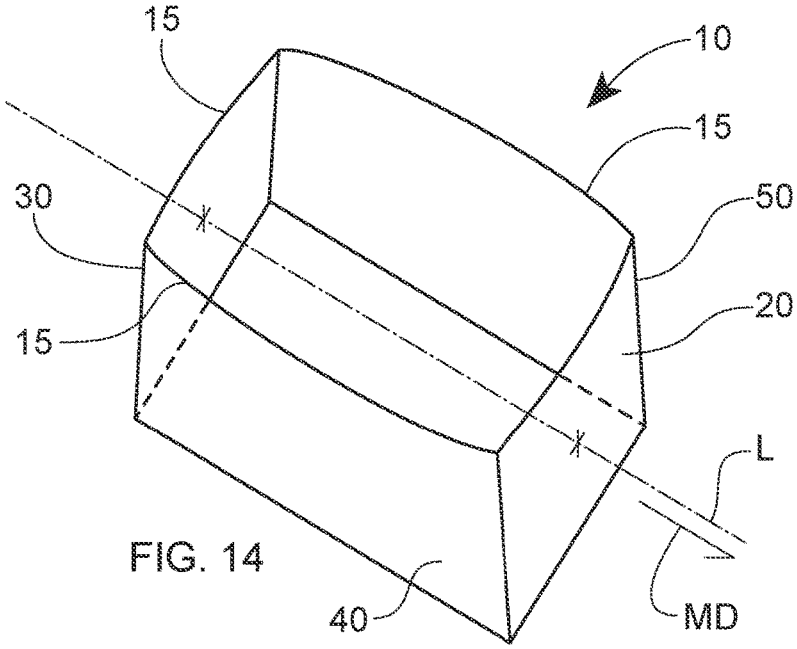
FIG. 14 illustrates a tray in which the front face and back face are outwardly bowed.

The carriage system 120 can be configured to convey the trays 10 in a condition in which the tray 10 is squeezed in the longitudinal direction so that the front face 40 and back face 50 are outwardly bowed away from the longitudinal axis L. The outward bowing of the front face 40 and the back face 50, as illustrated in FIG. 14, can arise during manufacture of the flat paperboard or corrugate. The amount of force applied in the machine direction MD and counter to the machine direction MD by the carriage system 120 can increase the amount of bowing as compared to the amount of bowing that might arise due to manufacture of the flat paperboard or corrugate and that which might arise as a result of transforming the flat paperboard or corrugate into a three-dimensional tray 10. Outwardly bowing the front face 40 and the back face 50, or having an outwardly bowed front face 40 and back face 50, can help provide for a tight fit between the hood 60 and the tray 10 and a secure engagement of the locking mechanism. The tray 10 can be bowed, by way of non-limiting example, in a carriage system 120 that employs linear motor vehicles 230 by controlling or setting the spacing between adjacent linear motor vehicles 230. The spacing between adjacent linear motor vehicles 230 can be set to be less than the distance between the leading face 20 and trailing face 30, as measured between the outer surfaces, of the tray 10 in an unloaded condition. The software operating the adjacent linear motor vehicles 230 can be programmed to control the amount of bowing desired at different positions along the carriage system 120, which may vary as a function of position. The panels of the hood 60 aligned with the front face 40 and the back face 50 can also be bowed as a result of folding the substrate between the hood top 90 and the panels of the hood 60 aligned with the front face 40 and the back face 50. If corrugate is used to form the hood 60 and the fold lines are orthogonal to flutes, the panels of the hood 60 aligned with the front face 40 and the back face 50 can be outwardly bowed.

The hood 60 can be engaged with the tray 10 by progressively pinching the front face 40 and back face 50 towards one another along the longitudinal axis L as the hood 60 is engaged with the tray 10. This may tend to load the substrate constituting the front face 40 and rear face 50 in compression while the tray 10 is squeezed between adjacent linear motor vehicles 230 as the tray 10 is conveyed downstream in the machine direction MD.

As described previously and shown in FIG. 7, the hood 60 can comprise a front panel inwardly folded flap 172 and a back panel inwardly folded flap 182. The hood 60 can be sized and dimensioned to fit tightly with the tray 10 so that the tray 10 may be securely closed. For a hood configured to include a front panel inwardly folded flap 172 and back panel inwardly folded flap 182, the hood can be engaged with the tray 10 by progressively pinching the front face 40 and the back face 50 towards one another along the longitudinal axis L with the front panel inwardly folded flap 172 and the back panel inwardly folded flap 182 as the hood 60 is engaged with tray 10 from the leading panel 70 to the trailing panel 80.

Figure 12:
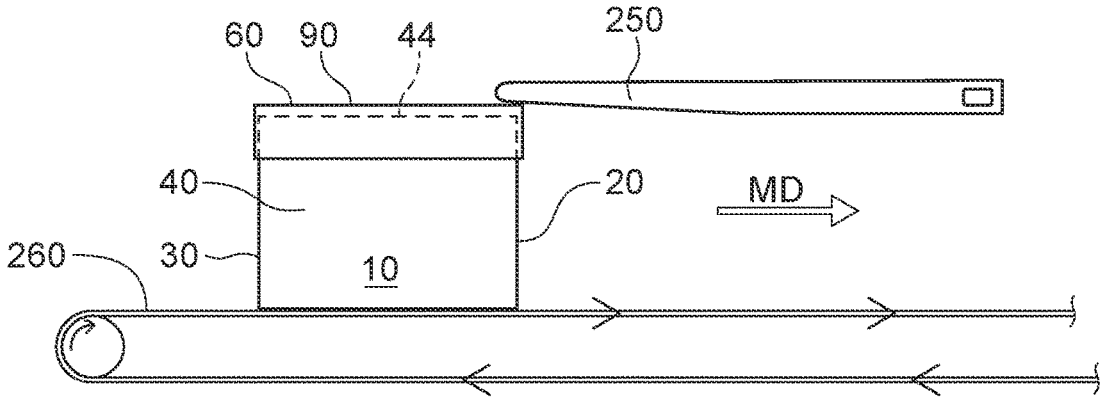
FIG. 12 illustrates a bumper system for telescopically fitting a hood to a tray after the hood has been captured by a tray.

Once the tray 10 has captured the front panel 170, or front panel inwardly folded flap 172, the hood 60 is at least partially fitted to the tray 10. As the tray 10 moves further downstream in the machine direction MD, the hood 60 can be further fitted to the tray 10 by providing a bumper 250 that pushes the hood 60 onto the tray 10 (FIG. 12). The bumper 250 can be configured to provide a reaction surface against which at least part of the hood 60 contacts. The distance between portions of the bumper 250 and the carriage system 120 can decrease as a function of distance in the machine direction. The bumper 250 can function as a wedge that pushes the hood 60 down onto the tray 10 as the tray 10 and hood 60 are conveyed in the machine direction downstream. The further fitting of the hood 60 to the tray 10 downstream of location at which the tray 10 first captures the hood 60 can occur while the tray 10 is held and under the control of the carriage system 120. As the tray 10 and hood 60 move in the machine direction MD, the hood 60 is telescopically fit to the tray 10. The bumper 250 can have a smooth surface that engages with the hood 60 so that the hood slides easily along the bumper 250. The smooth surface of the bumper 250 can be a polished steel or aluminum surface or a plastic material such as an acetal plastic or other plastic material having a low coefficient of friction and a smooth finish.

After the trailing panel 80 is fitted to the tray 10, the tray 10 and hood 60 engaged therewith can be handed off from the carriage system 120 to a downstream conveyor 260. A second bumper 250 can be positioned above the downstream conveyor 260 to further telescopically fit the hood 60 to the tray 10. The second bumper 250 can be wedge shaped or positioned to present a wedging surface to the hood 60 as the tray 10 and hood 60 are conveyed further downstream in the machine direction MD.

After the hood 60 is fitted to the tray 10 to form a closed package 110, the closed package 110 can be shipped from the location at which the closed package 110 is assembled. The closed package 110 can be shipped to a distribution center, customers, or consumers to finally reach the location at which the user opens the package 110 to use or consume the contents of the package 110.

The engagement mechanism between the hood 60 and the tray 10 can provide for a quality assurance check that the hood 60 is securely engaged with the tray 10. The package 110 can be removed from a downstream conveyor 260 by a picking robot or other device that picks up the package 110 by gripping or otherwise lifting the hood 60. The hood 60 can be gripped from underneath the hood side peripheral edges 100, or between the leading panel 70 and trailing panel 80, or between or panels of the hood oriented in the direction of the front face 40 and back face 50 of the tray 10, or a combination thereof. The hood 60 can optionally be lifted by a suction device applied to the hood top 90. The weight of the product 1 in the tray 10 will be supported or substantially supported by the engagement mechanism between the hood 60 and the tray 10. If the package 110 is securely closed, then the package 110 can successfully be picked up by the hood 60 and the hood 60 will not separate from the tray 10. If the engagement mechanism is not engaged properly, then hood 60 may separate from the tray 10 and that can be an indication that the package 110 was not securely closed. The tray 10 and the contents therein can remain on the conveyor 260 and be diverted to secondary handling area and the picking device can divert the disengaged hood to a secondary handling area.

Figure 13:
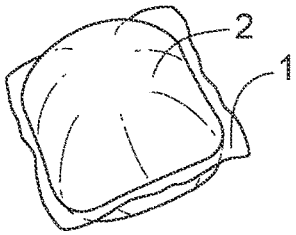
FIG. 13 illustrates a product that is a substrate treatment composition.

The substrate treatment composition 2 can be a water soluble unit dose article (FIG. 13). The article can be a pouch. From 1 to about 200, optionally from about 10 to 100, optionally from about 10 to about 40, water soluble unit dose articles can be dispensed into each tray 10 as it passes beneath the dispensing system 130. Each tray 10 can be sized and dimensioned to contain the aforesaid number of water soluble unit dose articles. Each tray 10 can have an interior volume from about 500 mL to about 5000 mL, optionally from about 800 mL to about 4000 mL.

The water soluble article can be formed of a water soluble film that envelopes substances for treating surfaces. The substances can be a laundry detergent, dish detergent, or similar product. The water soluble film can be a polyvinyl alcohol film. The water soluble unit dose article can be a single compartment pouch or a multi-compartment pouch. The compartments may be side by side or one above the other. Each water soluble pouch can weigh from about 10 g to about 40 g, or optionally from about 15 g to about 35 g.

Combinations:

An example is below:

A. A process for packaging a product (1) comprising the steps of: manufacturing the product, wherein said product is a substrate treatment composition;
   providing a tray carriage system (120);
   providing a tray (10) movable in or on said tray carriage system;
   moving said tray at a tray velocity (TV) via said tray carriage system in a machine direction (MD);
   providing a dispensing system;
   dispensing said product into said tray via said dispensing system;
   providing a hood engagement system above said tray carriage system and downstream of said dispensing system;
   providing a hood (60) moveable in said hood engagement system, wherein said hood comprises a leading panel (70), a trailing panel (80) opposite to and upstream of said leading panel, and a hood top (90) extending from said leading panel to said trailing panel, wherein said hood top is oriented at an angle (β) from about 0.5 degrees to about 20 degrees relative to said machine direction;
   engaging said hood with said tray via said hood engagement system to close said tray to form a closed package (110), wherein said hood is engaged with said tray while said tray is moving in said machine direction by initiating contact between said leading panel and said tray while said leading panel is moving before engaging said trailing panel with said tray; and shipping said closed package.

B. The process according to Paragraph A, wherein said hood engagement system comprises:
   a hood travel pathway oriented towards and at said angle to said carriage system, wherein said hood travel pathway is disposed between two hood drivers (220) opposite one another, wherein said hood drivers move said hood by contacting said hood.

C. The process according to Paragraph B, wherein each hood driver is selected from a belt, a roller, and combinations thereof.

D. The process according to any of Paragraphs A to C, wherein said leading panel is first engaged with said tray at a merging location along said tray carriage system, wherein said hood engagement system further comprises a hood guide above said tray carriage system at or downstream of said merging location, wherein said hood guide is nearer to said tray carriage system downstream of said merging location than at said merging location, wherein said hood guide contacts said hood top to telescopically fit said hood onto said tray.

E. The process according to any of Paragraphs A to D, wherein said hood has a pair of opposing hood side peripheral edges (100) extending between said leading panel and said trailing panel and said tray has a peripheral rim (15) defining a top opening (12) of said tray, wherein when said leading panel first contacts said tray about 5% to about 50% of each hood side peripheral edge is below said peripheral rim.

F. The process according to Paragraph E further comprising the steps of:
   moving said hood via said hood engagement system at a reference velocity (RV);
   altering said tray velocity in response to a detected position of said hood so that when said leading panel first contacts said tray about 15% to about 50% of each hood side peripheral edge is below said peripheral rim.

G. The process according to Paragraph E further comprising the steps of:
   moving said hood via said hood engagement system at a reference velocity (RV);
   altering said reference velocity in response to a detected position of said tray so that when said leading panel first contacts said tray about 15% to about 50% of each hood side peripheral edge is below said peripheral rim.

H. The process according to any of Paragraphs A to G, wherein said tray comprises:
   a leading face (20) and a trailing face (30) upstream of said leading face;
   a front face (40) and back face (50) opposite said front face, wherein said front face and said back face extend from said leading face to said trailing face in said machine direction;
   a peripheral rim (15) defining a top opening of said tray (15);
   a front face flap (46) extending from said peripheral rim along said front face;
   a back face flap (56) extending from said peripheral rim along said back face;
   wherein said process further comprises the step of folding said front face flap and said back face flap away from said top opening before engaging said hood with said tray and holding said front face flap and said back face flap down while engaging said hood with said tray.

I. The process according to any of Paragraphs A to H, wherein said hood further comprises a front panel and a back panel opposite said front panel, wherein said front panel and said back panel extend from said leading panel to said trailing panel, wherein said front panel comprises a front panel inwardly folded flap along at least a portion of said front panel, wherein said back panel comprises a back panel inwardly folded flap along at least a portion of said back panel, wherein said front panel inwardly folded flap and said back panel inwardly folded flap are between said front panel and said back panel.

J. The process according to any of Paragraphs A to I, wherein said substrate treatment composition comprises an ingredient selected from a surfactant, a bleach, a fabric softener, and combinations thereof.

K. The process according to any of Paragraphs A to J, wherein a plurality of said trays are provided in said tray carriage system, wherein the pitch amongst said trays is nonconstant and individually controlled.

L. The process according to any of Paragraphs A to K, wherein said tray carriage system comprises a plurality of linear motor vehicles, wherein a restraint plate oriented orthogonal to said machine direction is attached to each linear motor vehicle, wherein each said tray is held by restraint plates of adjacent linear motor vehicles.

M. The process according to any of Paragraphs A to L, wherein said tray comprises:

a leading face and a trailing face upstream of said leading face;

a front face and back face opposite said front face, wherein said front face and said back face extend from said leading face to said trailing face in said machine direction;

wherein said tray has a longitudinal axis in line with said machine direction and said front face and said back face are outwardly bowed away from said longitudinal axis.

N. The process according to any of Paragraphs A to M, wherein said tray comprises:

a leading face and a trailing face upstream of said leading face; and a front face (40) and a back face (50) extending from said leading face to said trailing face in said machine direction;

wherein said tray has a longitudinal axis in line with said machine direction and said front face and said back face are outwardly bowed away from said longitudinal axis when said leading panel and said tray are contacted;

wherein said hood is engaged with said tray by progressively pinching said front face and said back face towards one another along said longitudinal axis as said hood is engaged with said tray.

O. The process according to Paragraph N, wherein said hood further comprises a front panel and a back panel opposite said front panel, wherein said front panel and said back panel extend from said leading panel to said trailing panel, wherein said front panel comprises a front panel inwardly folded flap along at least a portion of said front panel, wherein said back panel comprises a back panel inwardly folded flap along at least a portion of said back panel, wherein said front panel inwardly folded flap and said back panel inwardly folded flap are between said front panel and said back panel, wherein said hood is engaged with said tray by progressively pinching said front face and said back face towards one another along said longitudinal axis with said front panel inwardly folded flap and said back panel inwardly folded flap as said hood is engaged with said tray from said leading panel to said trailing panel.

P. The process according to any of Paragraphs A to O, wherein said tray and said hood comprise corrugate.

Q. The process according to any of Paragraphs A to P, wherein said tray comprises:

a leading face (20) and a trailing face (30) upstream of said leading face;

a front face (40) and back face (50) opposite said front face, wherein said front face and said back face extend from said leading face to said trailing face in said machine direction;

a peripheral rim defining a top opening of said tray (15);

a front face flap extending from said peripheral rim along said front face;

a back face flap extending from said peripheral rim along said back face;

wherein said process further comprises the step of folding said front face flap and said back face flap away from top opening before engaging said hood with said tray and holding said front face flap and said back face flap down while engaging said hood with said tray, wherein said hood further comprises a front panel and a back panel opposite said front panel, wherein said front panel and said back panel extend from said leading panel to said trailing panel, wherein said front panel comprises a front panel inwardly folded flap along at least a portion of said front panel, wherein said back panel comprises a back panel inwardly folded flap along at least a portion of said back panel, wherein said front panel inwardly folded flap and said back panel inwardly folded flap are between said front panel and said back panel, wherein when said hood is engaged with said tray said front face flap is mechanically engaged with said front panel inwardly folded flap and said back face flap is mechanically engaged with said back panel inwardly folded flap.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for packaging a product comprising the steps of:

manufacturing the product, wherein said product is a substrate treatment composition;

providing a tray carriage system;

providing a plurality of trays movable in or on said tray carriage system at a pitch between said trays, wherein said pitch between said trays is nonconstant and individually controlled;

moving each of said plurality of trays at a tray velocity via said tray carriage system in a machine direction;

providing a dispensing system;

dispensing said product into said tray via said dispensing system;

providing a hood engagement system above said tray carriage system and downstream of said dispensing system;

providing a hood moveable in said hood engagement system, wherein said hood comprises a leading panel, a trailing panel opposite to and upstream of said leading panel, and a hood top extending from said leading panel to said trailing panel, wherein said hood top is oriented at an angle from about 0.5 degrees to about 20 degrees relative to said machine direction;

engaging said hood with said tray via said hood engagement system to close said tray to form a closed package, wherein said hood is engaged with said tray while said tray is moving in said machine direction by initiating contact between said leading panel and said tray while said leading panel is moving before engaging said trailing panel with said tray; and shipping said closed package.

2. The process according to claim 1, wherein said hood engagement system comprises:

a hood travel pathway oriented towards and at said angle to said carriage system, wherein said hood travel pathway is disposed between two hood drivers opposite one another, wherein said hood drivers move said hood by contacting said hood.

3. The process according to claim 2, wherein each hood driver is selected from a belt, a roller, and combinations thereof.

4. The process according to claim 1, wherein said leading panel is first engaged with said tray at a merging location along said tray carriage system, wherein said hood engagement system further comprises a hood guide above said tray carriage system at or downstream of said merging location, wherein said hood guide is nearer to said tray carriage system downstream of said merging location than at said merging location, wherein said hood guide contacts said hood top to telescopically fit said hood onto said tray.

5. The process according to claim 1, wherein said hood has a pair of opposing hood side peripheral edges extending between said leading panel and said trailing panel and said tray has a peripheral rim defining a top opening of said tray, wherein when said leading panel first contacts said tray about 5% to about 50% of each hood side peripheral edge is below said peripheral rim.

6. The process according to claim 5 further comprising the steps of:

moving said hood via said hood engagement system at a reference velocity;

altering said tray velocity in response to a detected position of said hood so that when said leading panel first contacts said tray about 15% to about 50% of each hood side peripheral edge is below said peripheral rim.

7. The process according to claim 5 further comprising the steps of:

moving said hood via said hood engagement system at a reference velocity;

altering said reference velocity in response to a detected position of said tray so that when said leading panel first contacts said tray about 15% to about 50% of each hood side peripheral edge is below said peripheral rim.

8. The process according to claim 5, wherein said tray comprises:

a leading face and a trailing face upstream of said leading face;

a front face and back face opposite said front face, wherein said front face and said back face extend from said leading face to said trailing face in said machine direction;

a peripheral rim defining a top opening of said tray;

a front face flap extending from said peripheral rim along said front face;

a back face flap extending from said peripheral rim along said back face;

wherein said process further comprises the step of folding said front face flap and said back face flap away from said top opening before engaging said hood with said tray and holding said front face flap and said back face flap down while engaging said hood with said tray.

9. The process according to claim 1, wherein said tray comprises:

a leading face and a trailing face upstream of said leading face;

a front face and back face opposite said front face, wherein said front face and said back face extend from said leading face to said trailing face in said machine direction;

a peripheral rim defining a top opening of said tray;

a front face flap extending from said peripheral rim along said front face;

a back face flap extending from said peripheral rim along said back face;

wherein said process further comprises the step of folding said front face flap and said back face flap away from said top opening before engaging said hood with said tray and holding said front face flap and said back face flap down while engaging said hood with said tray.

10. The process according to claim 9, wherein said hood further comprises a front panel and a back panel opposite said front panel, wherein said front panel and said back panel extend from said leading panel to said trailing panel, wherein said front panel comprises a front panel inwardly folded flap along at least a portion of said front panel, wherein said back panel comprises a back panel inwardly folded flap along at least a portion of said back panel, wherein said front panel inwardly folded flap and said back panel inwardly folded flap are between said front panel and said back panel.

11. The process according to claim 1, wherein said hood further comprises a front panel and a back panel opposite said front panel, wherein said front panel and said back panel extend from said leading panel to said trailing panel, wherein said front panel comprises a front panel inwardly folded flap along at least a portion of said front panel, wherein said back panel comprises a back panel inwardly folded flap along at least a portion of said back panel, wherein said front panel inwardly folded flap and said back panel inwardly folded flap are between said front panel and said back panel.

12. The process according to claim 1, wherein said tray and said hood comprise corrugate.

13. The process according to claim 1, wherein said tray carriage system comprises a plurality of linear motor vehicles, wherein a restraint plate oriented orthogonal to said machine direction is attached to each linear motor vehicle, wherein each said tray is held by restraint plates of adjacent linear motor vehicles.

14. The process according to claim 1, wherein said tray comprises:

a leading face and a trailing face upstream of said leading face; and a front face and a back face extending from said leading face to said trailing face in said machine direction;

wherein said tray has a longitudinal axis in line with said machine direction and said front face and said back face are outwardly bowed away from said longitudinal axis when said leading panel and said tray are contacted;

wherein said hood is engaged with said tray by progressively pinching said front face and said back face towards one another along said longitudinal axis as said hood is engaged with said tray.

15. The process according to claim 14, wherein said tray carriage system comprises a plurality of linear motor vehicles, wherein a restraint plate oriented orthogonal to said machine direction is attached to each linear motor vehicle, wherein each said tray is held by restraint plates of adjacent linear motor vehicles.

16. The process according to claim 15, wherein said hood further comprises a front panel and a back panel opposite said front panel, wherein said front panel and said back panel extend from said leading panel to said trailing panel, wherein said front panel comprises a front panel inwardly folded flap along at least a portion of said front panel, wherein said back panel comprises a back panel inwardly folded flap along at least a portion of said back panel, wherein said front panel inwardly folded flap and said back panel inwardly folded flap are between said front panel and said back panel, wherein said hood is engaged with said tray by progressively pinching said front face and said back face towards one another along said longitudinal axis with said front panel inwardly folded flap and said back panel inwardly folded flap as said hood is engaged with said tray from said leading panel to said trailing panel.

17. A process for packaging a product comprising the steps of:

manufacturing the product, wherein said product is a substrate treatment composition;

providing a tray carriage system;

providing a tray movable in or on said tray carriage system, wherein said tray comprises:

a leading face and a trailing face upstream of said leading face;

a front face and back face opposite said front face, wherein said front face and said back face extend from said leading face to said trailing face in said machine direction;

wherein said tray has a longitudinal axis in line with said machine direction and said front face and said back face are outwardly bowed away from said longitudinal axis;

moving said tray at a tray velocity via said tray carriage system in a machine direction;

providing a dispensing system;

dispensing said product into said tray via said dispensing system;

providing a hood engagement system above said tray carriage system and downstream of said dispensing system;

providing a hood moveable in said hood engagement system, wherein said hood comprises a leading panel, a trailing panel opposite to and upstream of said leading panel, and a hood top extending from said leading panel to said trailing panel, wherein said hood top is oriented at an angle from about 0.5 degrees to about 20 degrees relative to said machine direction;

engaging said hood with said tray via said hood engagement system to close said tray to form a closed package, wherein said hood is engaged with said tray while said tray is moving in said machine direction by initiating contact between said leading panel and said tray while said leading panel is moving before engaging said trailing panel with said tray; and shipping said closed package.

18. The process according to claim 17, wherein said hood is engaged with said tray by progressively pinching said front face and said back face towards one another along said longitudinal axis as said hood is engaged with said tray.

19. The process according to claim 17, wherein said tray carriage system comprises a plurality of linear motor vehicles, wherein a restraint plate oriented orthogonal to said machine direction is attached to each linear motor vehicle, wherein each said tray is held by restraint plates of adjacent linear motor vehicles.

20. The process according to claim 19, wherein said hood further comprises a front panel and a back panel opposite said front panel, wherein said front panel and said back panel extend from said leading panel to said trailing panel, wherein said front panel comprises a front panel inwardly folded flap along at least a portion of said front panel, wherein said back panel comprises a back panel inwardly folded flap along at least a portion of said back panel, wherein said front panel inwardly folded flap and said back panel inwardly folded flap are between said front panel and said back panel, wherein said hood is engaged with said tray by progressively pinching said front face and said back face towards one another along said longitudinal axis with said front panel inwardly folded flap and said back panel inwardly folded flap as said hood is engaged with said tray from said leading panel to said trailing panel.

* * * * *